US008602813B1

(12) United States Patent
Pan et al.

(10) Patent No.: US 8,602,813 B1
(45) Date of Patent: Dec. 10, 2013

(54) JUMPER ASSEMBLY

(75) Inventors: Jian-Chun Pan, Shenzhen (CN); Chung-Chi Huang, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/593,476

(22) Filed: Aug. 23, 2012

(30) Foreign Application Priority Data

Jul. 16, 2012 (CN) ..... 2012 1 0244971

(51) Int. Cl.
*H01R 31/08* (2006.01)

(52) U.S. Cl.
USPC ..... 439/510

(58) Field of Classification Search
USPC ..... 439/507–514
See application file for complete search history.

(56) References Cited

U.S. PATENT DOCUMENTS

| | | | | | |
|---|---|---|---|---|---|
| 4,955,824 | A * | 9/1990 | Pretchel et al. | ..... | 439/510 |
| 5,169,337 | A * | 12/1992 | Ortega et al. | ..... | 439/510 |
| 5,282,112 | A * | 1/1994 | Bremer | ..... | 439/510 |
| 5,810,617 | A * | 9/1998 | Hasagawa | ..... | 439/510 |
| 6,036,534 | A * | 3/2000 | Hoyt et al. | ..... | 439/510 |
| 6,099,347 | A * | 8/2000 | Hoyt et al. | ..... | 439/510 |
| 7,153,157 | B2 * | 12/2006 | Robinson et al. | ..... | 439/508 |
| 7,520,775 | B2 * | 4/2009 | Wu et al. | ..... | 439/507 |
| 7,713,083 | B1 * | 5/2010 | Sun et al. | ..... | 439/507 |
| 7,798,846 | B2 * | 9/2010 | Yuan | ..... | 439/510 |

* cited by examiner

*Primary Examiner* — Briggitte R Hammond
(74) *Attorney, Agent, or Firm* — Altis Law Group, Inc.

(57) ABSTRACT

A jumper assembly includes a circuit board, a first base, a second base, and a jumper. The first base and the second base are mounted on the circuit board. The first base includes a first pin electrically connected to the circuit board. The second base includes a second pin electrically connected to the circuit board. The second pin includes a limiting portion formed at a top. The jumper defines two through holes each receiving a conductive portion. The conductive portions of the jumper are electrically connected to each other. The jumper is set around the first pin and the second pin to electrically connect the first pin to the second pin. The limiting portion can prevent the second pin from disengaging from the jumper when response to the first pin is disengaged from the jumper.

12 Claims, 5 Drawing Sheets

JUMPER ASSEMBLY

BACKGROUND

1. Technical Field

The present disclosure relates to a jumper assembly.

2. Description of Related Art

In electronic devices, particularly, computers, jumpers are conductors used to close a break in or bypass part of an electrical circuit. Jumpers are typically used to set up or adjust printed circuit boards, such as the motherboards of the computers. Jumper pins (points to be connected by the jumper) are arranged in groups called jumper blocks, with each group having at least one pair of contact points and often more. In general, each contact in a jumper block terminates in a small metal pin. An appropriately sized conductive sleeve called a jumper, or more technically, a jumper shunt, is slipped over the pins to complete the circuit. When the jumper is used on the jumper block, two pins of the jumper block are connected to each other to form a closed circuit (ON state). Therefore, current may flow between the two pins. When the jumper is removed, the two pins are an open in the circuit (OFF state). However, once the jumper is removed from the motherboard, the jumper may be lost or misplaced and cannot easily be found because the jumper is very small, which will bring inconvenience to the user.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
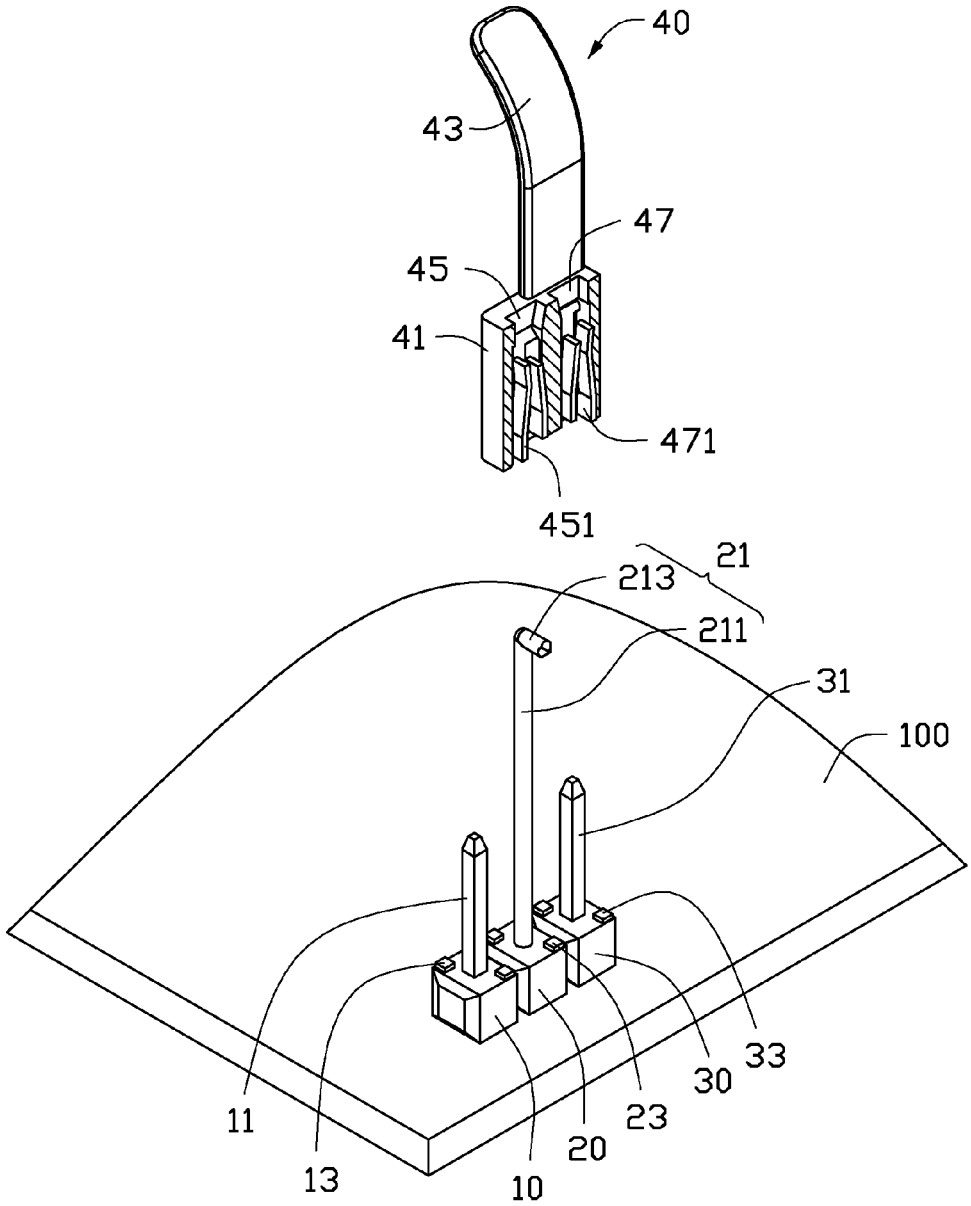
FIG. 1 is an exploded, isometric view of an embodiment of a jumper assembly.

Referring to FIG. 1, an embodiment of a jumper assembly includes a circuit board 100, a first base 10, a second base 20, a third base 30, and a jumper 40.

The first base 10, the second base 20, and the third base 30 are all mounted on the circuit board 100 in a line. The second base 20 is located between the first base 10 and the third base 30. The first base 10 includes a first pin 11 electrically connected to the circuit board 100. The second base 20 includes a second pin 21 electrically connected to the circuit board 100. The second pin 21 includes a pole 211 electrically connected to the circuit board 100 and a limiting portion 213 perpendicularly extending from a top end of the pole 211. The third base 30 includes a third pin 31 electrically connected to the circuit board 100. The first pin 11 and the third pin 31 each have a tapered top end.

Two cushions 13 are formed at opposite corners on a top surface of the first base 10, two cushions 23 are likewise formed on a top surface of the second base 20, and two cushions 33 are likewise formed on a top surface of the third base 10.

The jumper 40 includes a substantially rectangular main body 41 and an arc-shaped handle 43 extending from a top of the main body 41. The main body 41 defines a first through hole 45 and a second through hole 47 from top to bottom. A first conductive portion 451 is received in the first through hole 45. A second conductive portion 471 is received in the second through hole 47 and electrically connected to the first conductive portion 451. The first conductive portion 451 is a metal clip which can clamp onto the second pin 21. The second conductive portion 471 is a metal clip which can clamp onto the first pin 11 or the third pin 31.

Figure 2:
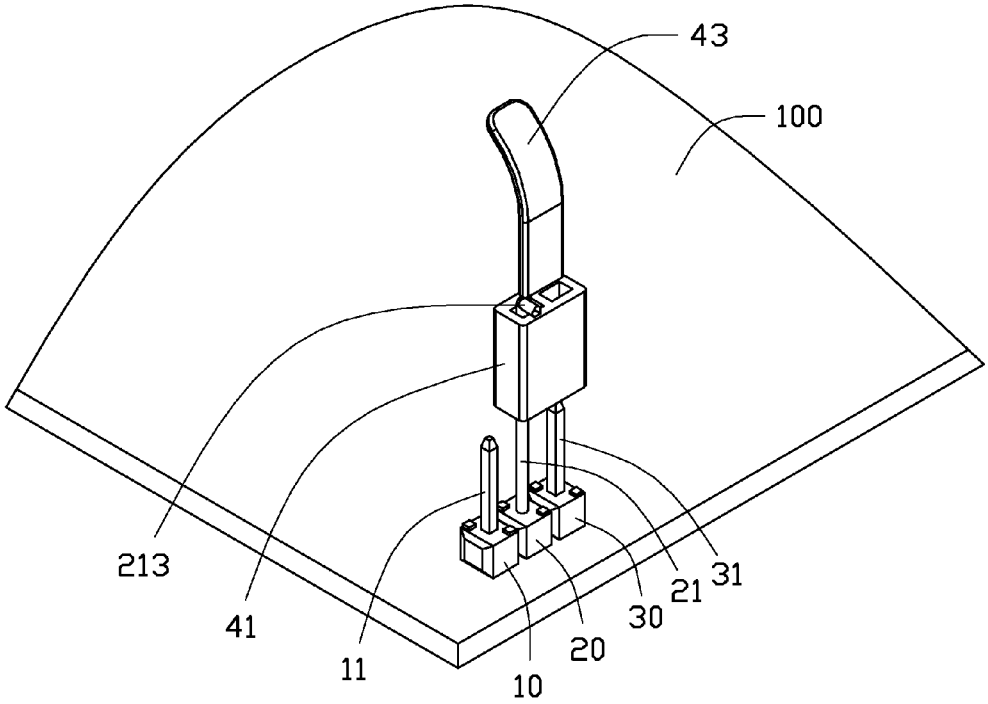
FIG. 2 is an assembled, isometric view of FIG. 1.

Referring to FIG. 2, in assembly, the pole 211 extends through the first through hole 45 to screw into the second base 20 and is electrically connected to the circuit board 100. The pole 211 electrically contacts with the first conductive portion 451.

Figure 3:
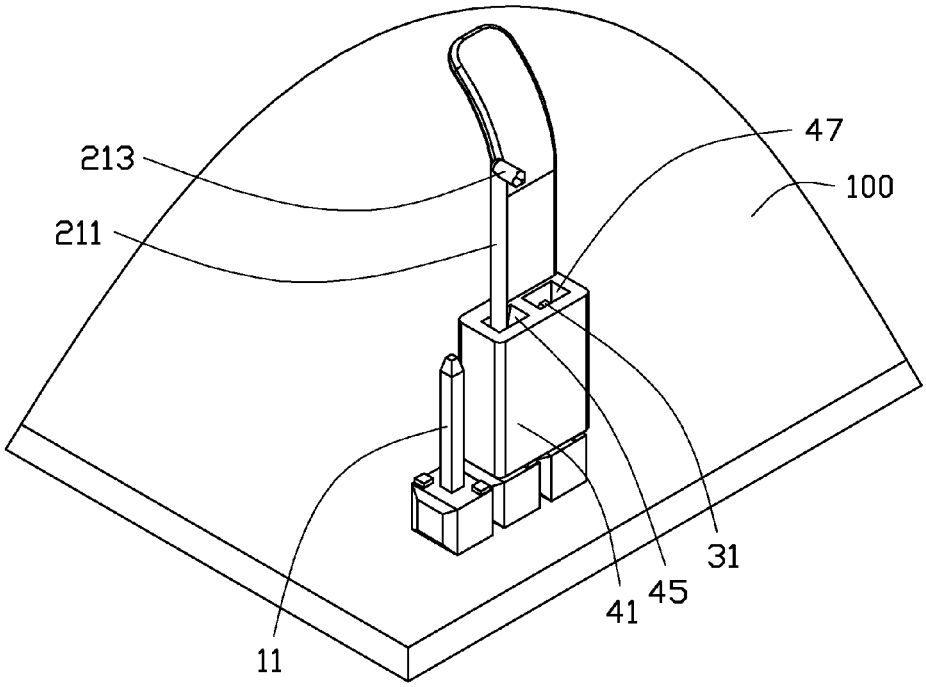
FIG. 3 to FIG. 5 are assembled, isometric views of FIG. 1, but showing different using states of the jumper assembly.
Figure 4:
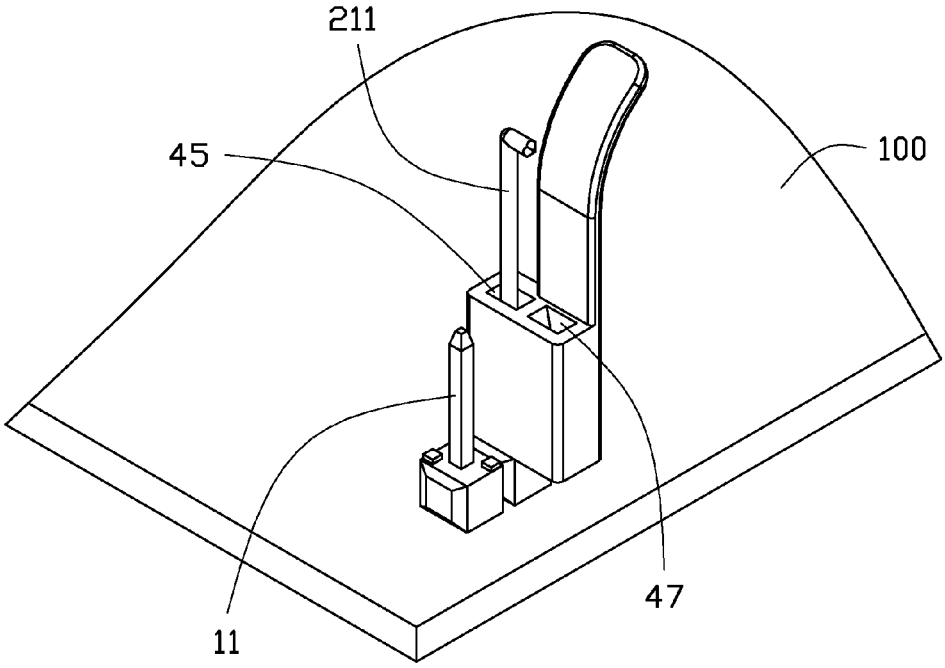
Figure 5:
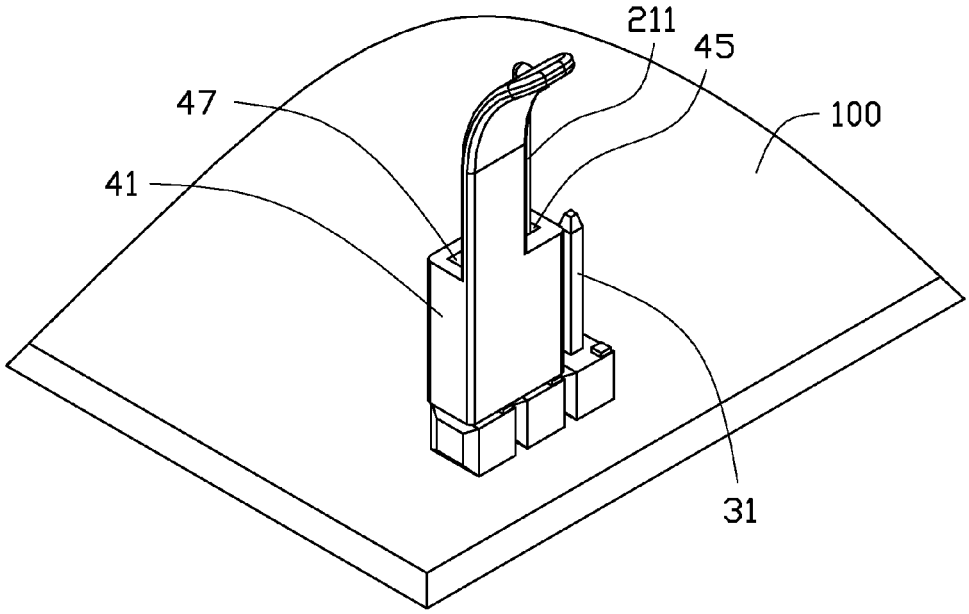

Referring to FIG. 3 to FIG. 5, to electrically connect the second pin 21 to the third pin 31, the jumper 40 is rotated about the pole 211 to align the second through hole 47 with the third pin 31. The jumper 40 is pressed down. The third pin 31 engages in the second through hole 47 and electrically contacts the second conductive portion 471, as shown in FIG. 3. To electrically connect the second pin 21 to the first pin 11, the jumper 40 is rotated about the pole 211 to align the second through hole 47 with the first pin 11. The jumper 40 is pressed down. The first pin 11 engages in the second through hole 47 and electrically contacts the second conductive portion 471, as shown in FIG. 5. To disconnect adjacent pins, the handle 43 is operated to move the jumper 40 up until the first pin 11 or the third pin 31 disengages from the second through hole 471. Then the jumper 40 can be rotated out of contact with any pins, as shown in FIG. 4. The limiting portion 213 prevents the jumper 40 from releasing from the pole 211 when the jumper 40 is moved up. The cushions 13, 23, 33 are used to cushion between the jumper 40 and the bases 10, 20, and 30.

In this embodiment, the first pin 11 and the third pin 31 are of equal height. The exposed portion of the pole 211 is longer than the sum of the height of the exposed portion of the first pin 11 and a height of the main body 41, to allow the main body 41 to disengage from the first pin 11 or the third pin 31 when the jumper 40 is blocked by the limiting portion 213.

In other embodiments, the first base 10, the second base 20, and the third base 30 may be arranged in a triangle formation.

Even though numerous characteristics and advantages of the embodiments have been set forth in the foregoing description, together with details of the structure and function of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A jumper assembly, comprising:

a circuit board, and a first base and a second base mounted on the circuit board, wherein the first base comprises a first pin electrically connected to the circuit board, the second base comprises a second pin electrically connected to the circuit board, the second pin comprises a limiting portion formed at a top end; and a jumper defining two through holes each receiving a conductive portion, wherein the conductive portions of the jumper are electrically connected to each other;

wherein the second pin extends through one of the through holes of the jumper and contacts the corresponding conductive portion, the first pin extends through the other through hole of the jumper and contacts the corresponding conductive portion, thereby connecting the first pin with the second pin, the limiting portion is operable to prevent the second pin from disengaging from the corresponding through hole when response to the first pin is disengaged from the corresponding through hole.

2. The jumper assembly of claim 1, wherein each of the first base and the second base comprises two cushions cornerwise formed on a top surface.

3. The jumper assembly of claim 1, wherein the second pin comprises a pole electrically connected to the circuit board, the limiting portion perpendicularly extends from a top end of the pole.

4. The jumper assembly of claim 3, wherein the jumper comprises a substantially rectangular main body and an arc-shaped handle extending from a top of the main body, the through holes are defined in the main body from top to bottom.

5. The jumper assembly of claim 4, wherein the exposed portion of the pole is longer than the sum of the height of the exposed portion of the first pin and a height of the main body.

6. A jumper assembly, comprising:

a circuit board, and a first base, a second base, and a third base mounted on the circuit board, wherein the first base comprises a first pin electrically connected to the circuit board, the second base comprises a second pin electrically connected to the circuit board, the third base comprises a third pin electrically connected to the circuit board, the second pin comprises a pole electrically connected to the circuit board and a limiting portion extending from a top end of the pole; and a jumper defining a first through hole and a second through hole each receiving a conductive portion, wherein the conductive portions of the jumper are electrically connected to each other;

wherein the second pin rotatably extends through the first through hole and contacts the corresponding conductive portion, the first pin or the third pin is operable to extend through the second through hole and contacts the corresponding conductive portion, the limiting portion is operable to prevent the second pin from disengaging from the first through hole when response to the first pin or the third pin is disengaged from the second through hole.

7. The jumper assembly of claim 6, wherein each of the first base, the second base, and the third base comprises two cushions cornerwise formed on a top surface.

8. The jumper assembly of claim 6, wherein the jumper comprises a substantially rectangular main body and an arc-shaped handle extending from a top of the main body, the first and second through holes are defined in the main body from top to bottom.

9. The jumper assembly of claim 8, wherein the exposed portion of the pole is longer than the sum of the height of the exposed portion of the first pin and a height of the main body.

10. The jumper assembly of claim 6, wherein a height of the first pin is equal to a height of the third pin.

11. The jumper assembly of claim 6, wherein the first base, the second base, and the third base are arranged in a triangle formation.

12. The jumper assembly of claim 6, wherein the first base, the second base, and the third base are arranged in a line.

* * * * *